US007412730B2

(12) United States Patent
Schroeder

(10) Patent No.: US 7,412,730 B2
(45) Date of Patent: Aug. 19, 2008

(54) GARMENT STRAP ASSEMBLY AND PANTS HOLDING METHOD

(76) Inventor: Keri Schroeder, 19836 NE. Redmond Rd., Redmond, WA (US) 98053

( * ) Notice: Subject to any disclaimer, the term of this patent is extended or adjusted under 35 U.S.C. 154(b) by 69 days.

(21) Appl. No.: 11/444,858

(22) Filed: May 31, 2006

(65) Prior Publication Data

US 2006/0272076 A1 Dec. 7, 2006

Related U.S. Application Data

(60) Provisional application No. 60/688,225, filed on Jun. 6, 2005.

(51) Int. Cl.
*A41F 9/00* (2006.01)

(52) U.S. Cl. ..... 2/340

(58) Field of Classification Search ..... 2/79, 2/227, 329, 326, 327, 328, 336, 310, 340
See application file for complete search history.

(56) References Cited

U.S. PATENT DOCUMENTS 4,715,839 A * 12/1987 Ford et al. ..... 446/28
6,006,365 A * 12/1999 Strandberg ..... 2/329
6,260,749 B1 * 7/2001 Horovitz ..... 224/183

* cited by examiner

*Primary Examiner*—Tejash Patel
(74) *Attorney, Agent, or Firm*—Dean A. Craine

(57) ABSTRACT

A garment strap assembly used to hold up an individual's pants by attaching one end of the strap assembly to the waist and then holding the opposite end of the strap in an extended position under the wearer's upper garment. The strap assembly includes an elastic strap with an alligator-style clip attached to its proximal end that selectively attaches to the upper edge of the pant's waist. Attached to distal end of the strap is first magnet. During use, the clip is attached to the waist band and the strap extends upward and under the upper garment a sufficient elevation to exert an upward force on the waist band. A decorative button with a second magnet located therein is placed over the outside surface of the upper garment opposite the first magnet. The first and second magnets are magnetically attracted to securely hold the strap in fixed position under the upper garment. An optional shielding cap is placed over the outer surface of the second magnet to prevent the second magnet from be attracted to other metallic objects located nearby.

6 Claims, 2 Drawing Sheets

GARMENT STRAP ASSEMBLY AND PANTS HOLDING METHOD

This utility patent application is based on the provisional patent application (Ser. No. 60/688,225) filed on Jun. 6, 2005.

BACKGROUND OF THE INVENTION

1. Field of the Invention

The invention disclosed herein pertains to elastic straps, and more particularly to elastic straps used to hold up a pair of pants.

2. Description of the Related Art

It is well known that small children find it difficult keeping a pair of pants up around their waist. One reason for this is that the waist and buttock area on a child's pair of pants are proportionally larger to accommodate a diaper worn by the child. When a plastic diaper is worn, the pants tend to slide downward over the diaper. Another reason is that small children often crawl on the ground which also tends to pull a child's long pair of pants downward.

Another reason why pants keep falling off a child is that the pants are too large. Most children pants are manufactured in six month size intervals. Parents or guardians typically purchase pants one size above the child's current size so that the child grows into the pants. Until the child grows into the pants, the oversize pants are inclined to fall.

These facts along with the fact that most small children do not have the mental capacity nor the physical strength to pull up their pants, forces the child's parent or guardian to be constantly monitor the height of the child's pants and to find safe ways and effective ways to hold them up.

One common item used to hold up a child's pair of pants is pair of elastic suspenders or a belt. Unfortunately with very small children (3 to 18 months), many parents and guardians are fearful that the suspenders and belt may become undone and accidentally strangle the child.

Another way to overcome the problem of fallen pants on a child is for the child to wear full body jumpers or outfits with a separate matching blouse or shirt top and pants which button or snap-fit together. One drawback with outfits made of matching top and pants is that the pants and tops must be used together. Another drawback with these outfits is that the buttons or snap connectors may be lost or broken.

SUMMARY OF THE INVENTION

It is an object of the present invention to provide apparatus for securely holding up an individual's pair of pants.

It is another object of the present invention to provide such an apparatus that can be used with any standard pair of pants, blouse or shirt commonly found in an individual's wardrobe.

It is another object of the present invention to provide such an apparatus that can be selectively and easily connected and disconnected from the pants, blouse or shirt.

These and other objects are met by the removable garment strap assembly disclosed herein used to hold up an individual's pair of pants. The strap assembly includes an elastic strap with a waist attachment means attached to its lower proximal end. In the preferred embodiment, the waist attachment means is an alligator-style clip that attaches the perimeter edge of the waist. When the clip is attached to the waist, the strap is then pulled upward so that it extends above the waist and under the inside surface of the upper garment worn by the child.

Securely attached to distal end of the strap is a first magnet. During assembly, the strap is extended sufficiently upward and under the upper garment so that the strap is stretched and the first magnet is positioned at an elevated position above the waist. The assembly also includes a separate button with a second magnet designed to be magnetically attracted to the first magnet when the button is placed over the outer surface of the upper garment directly over the first magnet. The attraction between the first and second magnets are sufficient to securely hold the strap in a stretched position over the inside surface of the upper garment. An optional shielding cap is placed over the outer surface of the second magnet to prevent the second magnet from be attracted to other metallic objects positioned nearby. In the preferred embodiment, the separate button is covered with a decorative fabric body so that it appears as a decorative component of the upper garment.

Using the above garment strap assembly, a method for holding up a pair of pants on an individual is also provided.

DESCRIPTION OF THE PREFERRED EMBODIMENT(S)

Figure 1:
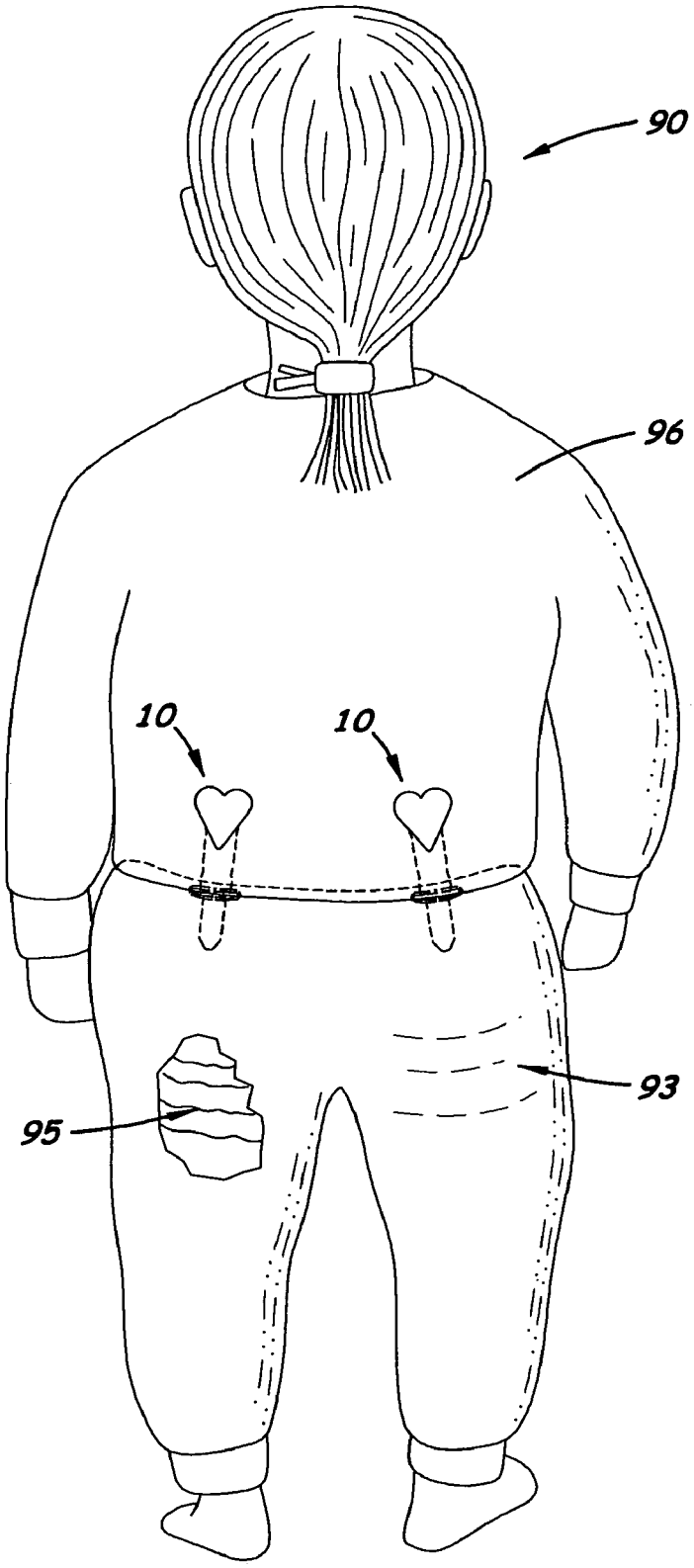
FIG. 1 is a rear elevational view of a child with the strap apparatus disclosed herein being used to hold up a child's pair of pants.
Figure 2:
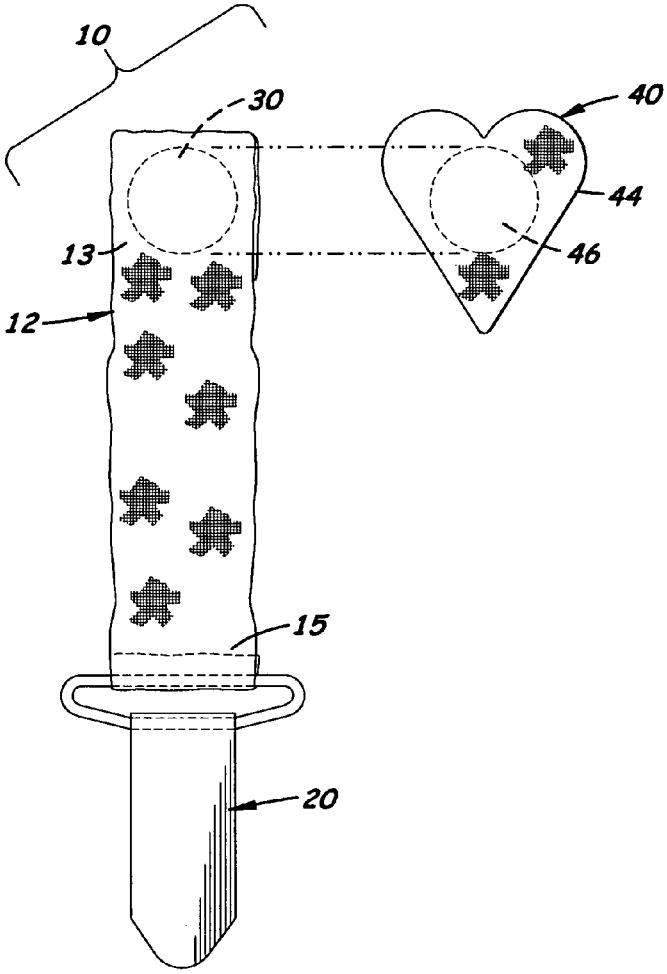
FIG. 2 is a front elevational view of the strap assembly.
Figure 3:
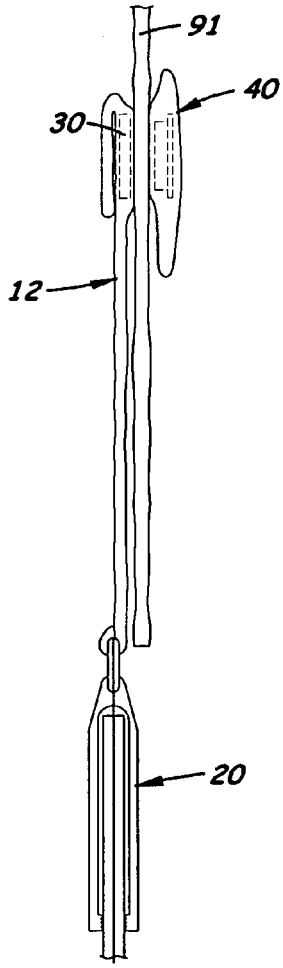
FIG. 3 is a side elevational view of the strap assembly shown in FIG. 2.
Figure 4:
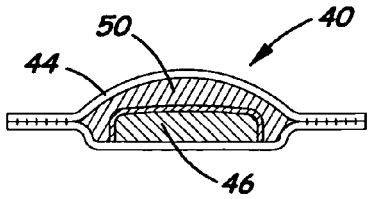
FIG. 4 is a sectional side elevational view of the button taken along line 4-4 in FIG. 2.

Shown in the accompanying FIGS. 1-4, there is shown a removable garment strap assembly 10 disclosed herein used to hold up a small child's pants 93 around the waist by attaching the waist of the pants 93 to the child's upper garment 96 The strap assembly 10 includes an elastic strap 12 with an alligator-style clip 20 securely attached to the strap's proximal end.

The alligator-style clip 20 is designed to open sufficiently wide so that the upper edge of the waist band may be inserted. The alligator-style clip 20 is spring loaded to grasp onto the waist edge. In the preferred embodiment, the clip includes a triangular-style ring around which the proximal end 15 of the strap of the may attach. During use, the clip 20 is attached to the waist on the pants 93 and extends upward therefrom and under the upper garment 96. Attached to distal end of the strap 12 is first magnet 30. The strap 12 is extended sufficiently upward and under the upper garment 96 so that the first magnet 30 is positioned at an elevated position and sufficient upward force is exerted by the strap 12 to hold the child's pants 93 up.

A decorative button 40 with a decorative outer fabric body 44 with a second magnet 46 located therein is placed on the outside surface of the upper garment 96 opposite the first magnet 30. The first and second magnets 30, 46, respectively, are magnetically attracted to securely hold the strap 12 in and upward extending position under the upper garment 96. A shielding cap 50 is placed over the outer surface of the second magnet 46 to prevent the second magnet 46 from be attracted to other metallic objects and being disengaged from the first magnet 30.

In the preferred embodiment, the strap 12 is made for a child and is made of light elastic material approximately 3 inches in length and 2 inches in width. It should be understood that the strap assembly 10 could be used by other individuals, such as teenagers or small adults. With larger individuals, the strap 12, clip 20, first magnet 30, decorative button 40, and second magnet 46 would be proportioned larger.

In the embodiment shown in the Figs. there are four strap assemblies 10 spaced evenly around the waist of the user. It should be understood that as few as one strap assembly 10 or as many as six strap assemblies 10 may be used.

Also disclosed herein is a method for holding up a pair of pants 93, comprising the following steps:

a. selecting a strap assembly 10 that includes an elastic strap 12 with a proximal end 15 and an opposite distal end 13, a clip 20 attached to said proximal end 15 of said strap assembly 10, a first magnet 30 located in said distal end 13 of said strap 12; and a button 40 that includes a second magnet 46;

b. attaching said clip 20 to the waist of a pair of pants 93 worn by an individual 90;

c. pulling said elastic strap 12 upward under an upper garment 96 worn by the individual 90 until the pair of pants 93 is pulled upward to the desired height around the individual 90; and, d. placing said button 40 over said distal end of said elastic strap 12 so that the second magnet 46 is attracted to said first magnet 30 to hold said elastic strap 12 upward.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A garment strap assembly consisting of:

a. an elastic strap that includes a proximal end and an opposite distal end;

b. a means for selectively attaching proximal end of said strap to the waist of a pair of pants worn by a child;

c. a first magnet attached to said distal end of said strap; and, d. a button; and, e. a second magnet attached to said button, said second magnet being magnetically attracted to said first magnet so that when said means for selectively attaching said proximal end of said strap is attached to the waist of a pair of pants, and said strap is pulled upward and under an upper garment worn by an individual, said button may be positioned over the outer surface of the upper garment and over said first magnet to hold said strap upward and under the upper garment.

2. The garment strap as recited in claim 1, wherein said second magnet includes an outer magnetic shield over said second magnet, said magnetic shield being used to preclude said second magnet from being attracted to a metallic surface located nearby.

3. The garment strap as recited in claim 2, wherein said first and second magnets are made of neodymium iron boron.

4. The garment strap as recited in claim 1, wherein said means for selectively attaching said proximal end of said strap to the waist is an alligator-style clip capable of grasping the waist on a pair of pants.

5. A method for holding up a pair of pants worn by an individual consisting of the following steps:

a. selecting at least one garment strap assembly that includes an elastic strap with a proximal end and an opposite distal end, a clip attached to said proximal end of said strap, a first magnet located on said distal end of said strap, and a decorative button that includes a second magnet magnetically attracted to said first magnet;

b. attaching said clip to the waist of a pair of pants worn by an individual;

c. pulling said elastic strap upward under an upper garment worn by the individual until the waist on the pair of pants is pulled upward to the desired height; and, d. placing said decorative button over the outside surface of the upper garment and over said distal end of said elastic strap so that the second magnet is attracted to said first magnet thereby holding said elastic strap upward and under said upper garment.

6. The method for holding up a pair of pants as recited in claim 5, further including the following steps:

e. selecting a second garment strap assembly that includes an elastic strap with a proximal end and an opposite distal end, a clip attached to said proximal end of said elastic strap, a first magnet located on said distal end of said elastic strap, and a decorative button that includes a second magnet magnetically attached to said first magnet;

f. attaching said clip on said proximal end of said elastic strap on said second garment strap assembly to the waist of a pair of pants worn by an individual;

g. pulling said elastic strap on said second garment strap assembly upward under an upper garment worn by the individual until the waist on the pants is pulled upward to a desired height; and, h. placing said decorative button over the outside surface of the garment and over said first magnet on said second garment strap assembly.

* * * * *